United States Patent [19]

Bürer

[11] 4,117,871

[45] Oct. 3, 1978

[54] YARN CLAMP FOR A WEAVING MACHINE

[75] Inventor: Franz Bürer, Kollbrunn, Switzerland

[73] Assignee: Sulzer Brothers Limited, Winterthur, Switzerland

[21] Appl. No.: 798,352

[22] Filed: May 19, 1977

[30] Foreign Application Priority Data

Jun. 3, 1976 [CH] Switzerland ..... 6993/70

[51] Int. Cl.[2] ..... D03J 5/06

[52] U.S. Cl. ..... 139/429; 139/448; 139/196.2; 24/132 R

[58] Field of Search ..... 139/194, 196.2, 429, 139/448, 450, 439; 24/132

[56] References Cited

U.S. PATENT DOCUMENTS 3,662,785 5/1972 Kokkinis ..... 139/448

3,878,587 4/1975 Marti ..... 24/132 R 3,929,169 12/1975 Pfarrwaller ..... 139/429

FOREIGN PATENT DOCUMENTS 1,325,416 3/1963 France ..... 139/196.2

*Primary Examiner*—Henry S. Jaudon

*Attorney, Agent, or Firm*—Kenyon & Kenyon Reilly Carr & Chapin

[57] ABSTRACT

At least one of the clamping surfaces of the yarn clamp is provided with a recess which extends longitudinally of the clamping jaws and along the yarn path. The recess is of a depth, at most, equal to the yarn thickness so as to ensure a reliable engagement of the yarn in accurate position for transfer, for example, to a shuttle. Guide teeth may also be provided on one of the jaws in order to effect centering of the yarn into the recess.

8 Claims, 8 Drawing Figures

YARN CLAMP FOR A WEAVING MACHINE

As is known, yarn clamps, particularly for weaving machines, usually have two clamping jaws which engage by way of registering clamping surfaces with a yarn, such as a weft yarn in a weaving machine. Usually, the yarn is presented to the clamp in a stretched state and, at least one of the clamping jaws is movable relative to the other jaw.

The clamping jaws of such yarn clamps can, of course, have clamping surfaces which are adapted to lie substantially parallel on each other in the closed position. However, malfunctioning of these known clamps may occur if the clamping gap between the jaws becomes too wide and particularly if the yarn material being dealt with is relatively thick. In such a case, loose parts of the clamped yarn, e.g. discrete filaments of a filament yarn comprising a number of discrete filaments, may project laterally from the clamping gap or nip and not be engaged by the jaws. During further processing, e.g. during transfer to a weft-picking element of a weaving machine, the loose yarn parts may become detached from the clamped yarn part and therefore not be picked into a shed of the weaving machine. As a result, defects can occur in the cloth.

Accordingly, it is an object of the invention to provide a yarn clamp which ensures that a yarn to be processed is engaged completely.

It is another object of the invention to provide a yarn clamp of relatively simple construction for securely clamping a yarn.

Briefly, the invention provides a yarn clamp which includes a pair of clamping jaws each of which has a clamping surface opposite a clamping surface of the other jaw for registering with the opposite clamping surface to engage a yarn therebetween. At least one of the jaws is movable relative to the other jaw and at least one jaw includes a groove-like recess in a clamping surface. This recess extends longitudinally of the jaws parallel to the yarn and over a region in which the clamping surfaces register with each other to receive the yarn.

The recess in the clamping surface is of a depth at most equal to the yarn thickness occurring during clamping.

Correspondingly, the clamping jaws can be arranged either to engage flush with one another in the clamping position or to move towards one another until a preferably narrow clamping gap sufficient to maintain clamping remains between them. In the latter case, the gap is such that the yarn parts located outside the recess can be engaged reliably.

According to another feature of the invention, in order to provide a very reliable yarn clamp from items which are simple to produce, the recess, as considered lengthwise of the yarn, has substantially the shape of a circle section and is bounded on both sides by substantially flat portions of the clamping surface in the region of registration. A particular advantage of this feature is that the yarn is treated very gently, since the clamping force is applied to the engaged piece of yarn uniformly over a relatively wide clamping zone, the lateral flat portions of the clamping surface may also provide a clamping effect. Another advantage of this feature is that yarns of various thickness or a yarn introduced, e.g. eccentrically into the clamp can be engaged reliably.

In order to increase the clamping force applied to the yarn to be engaged with very little stressing and deformation (width squeezing) of the yarn, particularly when yarn transfer is precise — i.e. when the yarn presented deviates little laterally from a predetermined clamping position — the recess can have the shape of a groove receiving some of the cross-section of the yarn. In this case, the groove width as measured transversely of yarn length corresponds approximately to the thickness of the unclamped yarn.

In order to effect a very simple way of centering the yarn to be engaged in an accurately predetermined clamping zone of the clamp, the clamp can have at least two guide teeth which are disposed on both sides of the yarn path, project from the associated clamping surface and form, by way of their sides which are near one another and disposed transversely of yarn length, lateral boundaries of the clamping region.

These and other objects and advantages of the invention will become more apparent from the following detailed description and appended claims taken in conjunction with the accompanying drawings in which:

Figure 1:
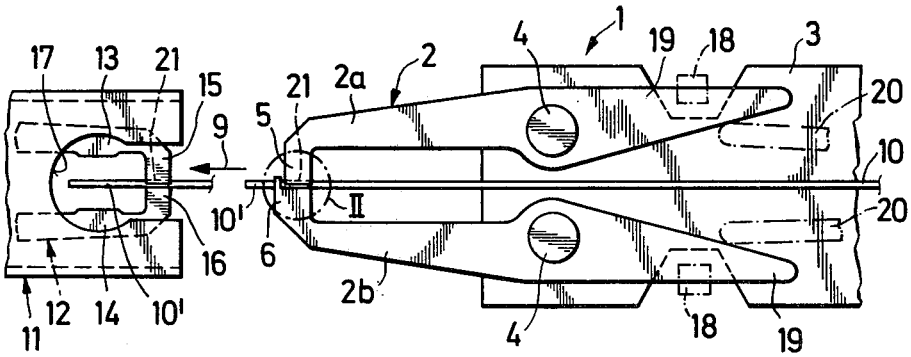
FIG. 1 illustrates a yarn feeder and a weft picking element of a weaving machine employing a yarn clamp according to the invention both being shown in partial form.

Referring to FIG. 1, a yarn feeder 1 comprises a yarn clamp 2 having a pair of elongated arms or levers *2a, 2b* disposed longitudinally of a yarn path and mounted in known manner for pivoting around pivots 4 disposed on a carrier or support member 3. Both of the arms *2a, 2b* are movable towards the other and towards the yarn path. Each arm *2a, 2b* has a clamping jaw 5, 6 disposed at one end with a clamping surface 7, 8 opposite the clamping surface on the other jaw for registering with the opposite clamping surface to engage a yarn 10 in the yarn path therebetween.

The yarn 10 is the weft yarn of a weaving machine (not shown) and runs off a weft supply bobbin (not shown) which remains outside the shed during picking. In known manner, the feeder 1 transfers the weft yarn 10 to a picking element — a picking shuttle or projectile 11 in the example shown — which picks the yarn into a shed (not shown) in the direction indicated by an arrow 9. After picking, the weft yarn 10 is severed and beaten up on the edge of the cloth. The weft yarn end 10' which remains outside the shed is engaged by the feeder 1 and prepared for a subsequent pick.

The shuttle 11 comprises a yarn clamp 12 having two elongated resilient clamping arms 13, 14 formed at their ends with clamping jaws 15, 16. At the transfer of yarn 10 from the feeder 1 to the shuttle 11, the shuttle 11 is in a position which is offset by 90° around the longitudinal axis of the yarn 10 as compared with the illustration of FIG. 1. An opener (not shown) actuated by the drive of the weaving machine opens the arms 13, 14 so that the jaws 5, 6 of the clamp 2, moving lengthwise of the yarn as indicated by the arrow 9, can enter a recess 17 in the shuttle 11. As the opener moves back, the arms 13, 14 close, engaging the yarn 10 between them.

A fork 18 which is actuated by the machine drive and which moves up laterally onto the outside of the free arms 19 of the arms *2a, 2b* then opens the yarn clamp 2. The arms 19 are pressed together against the force of two spring arms 20 so that the jaws 5, 6 release the yarn 10. The feeder 1 is then returned towards the shed to prepare a new weft yarn for the next pick.

Figure 2:
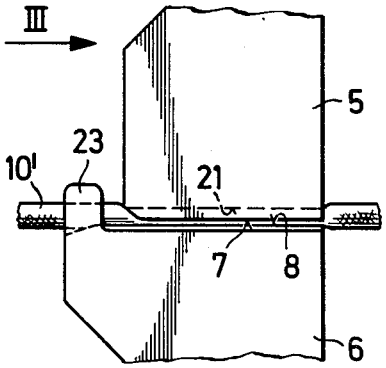
FIG. 2 illustrates a side view of a detail of FIG. 1 to an enlarged scale.
Figure 3:
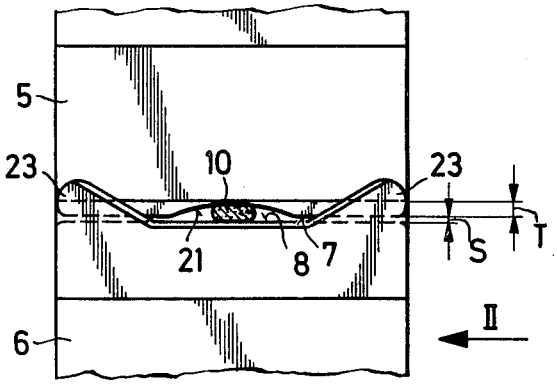
FIG. 3 illustrates a view taken in the direction of the arrow III of FIG. 2.

Referring to FIGS. 2 and 3, the clamping surface 8 of one jaw 6 is plane, i.e. flat, but the clamping surface 7 of the other jaw 5 is formed with a groove-like recess 21 extending in the direction of yarn length, i.e. longitudinally of the yarn path. The groove-like recess 21 also extends over a region in which the clamping surfaces 7, 8 register with each other to receive the yarn 10 in the yarn path while being disposed centrally of the jaw 5 as shown.

As considered in the direction of yarn length, the recess 21 has a shape corresponding to a part of a circle, i.e. a segmental circular cross-sectional shape. The width of the recess 21 as measured transversely of the yarn length is approximately one-third of the width of the jaw 5. The depth T of the recess 21 is less than the thickness of the yarn 10 during clamping so that a gap S is left between the surfaces 7, 8 in the clamping position.

The jaw 6 also has two guide teeth 23 on opposite sides relative to the yarn path which project out of the surface 8 towards the plane of the other jaw 6 to define lateral boundaries of the clamping region. Those sides of the teeth 23 which are near one another, each include an obtuse angle with the surface 8. The distance between the teeth 23 near the clamping surface 8 corresponds approximately to the width of the recess 21.

Figure 4:
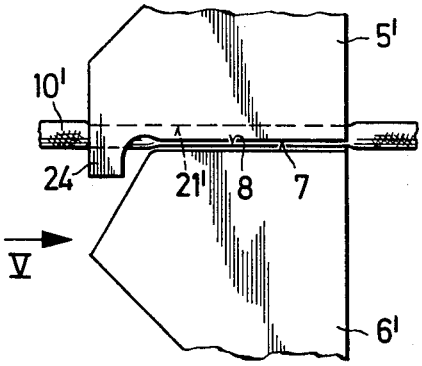
FIG. 4 illustrates a side view of a modified yarn clamp according to the invention.
Figure 5:
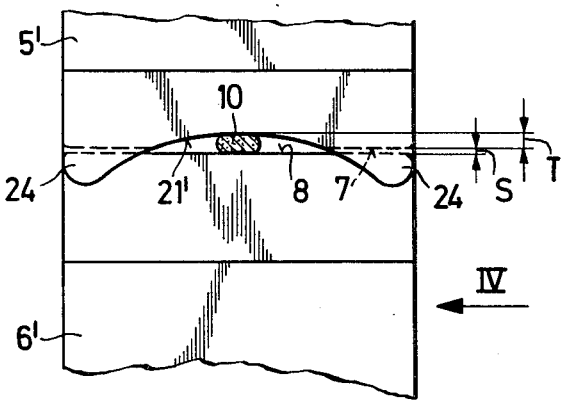
FIG. 5 illustrates a view taken in the direction of the arrow V of FIG. 4.

Referring to FIGS. 4 and 5, wherein like reference characters indicate like parts as above, a yarn clamp which has clamping jaws 5', 6' and a clamping surface 7 with a recess 21' similar to the recess 21 of FIG. 3, is formed so that the width of the recess 21' is about half the width of the jaw 5. In this embodiment, the jaw 5' has two guide teeth 24 wherein the sides which face one another are adapted to the shape of the recess 21' so as to merge into the recess 21'.

Figure 6:
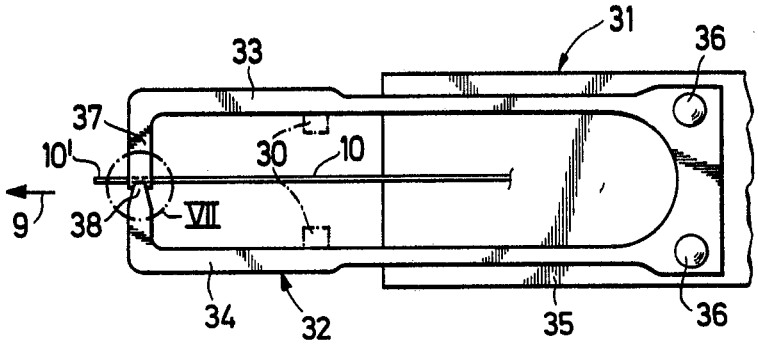
FIG. 6 illustrates a yarn feeder of another embodiment of the invention.

Referring to FIG. 6, a yarn feeder 31 may alternatively be constructed with a yarn clamp 32 which is formed from a spring clip or the like and which has two elongated clamping arms 33, 34 on opposite sides of a yarn path. The clamp 32 is secured by two rivets 36 to a carrier or support member 35 actuated by the machine drive. The arms 33, 34 are biased so that their ends, which have clamping jaws 37, 38, are pressed against one another — i.e. on to the yarn 10 to be engaged — by way of registering clamping surfaces 39, 40 visible in FIG. 8. A fork 30 actuated by the machine drive and adapted to move onto the inside of the arms 33, 34 to spread the arms 33, 34 is provided to open the clamp 32.

Figure 7:
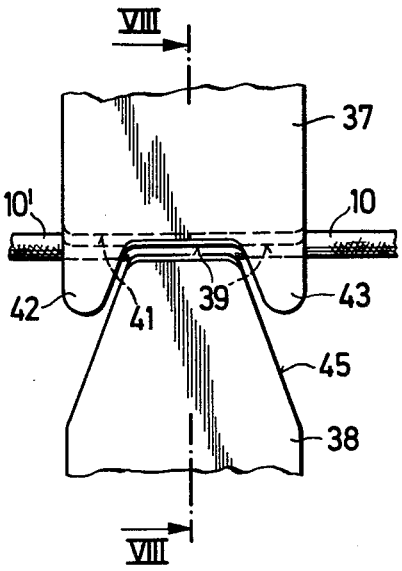
FIG. 7 illustrates a detail of FIG. 6 to an enlarged scale.
Figure 8:
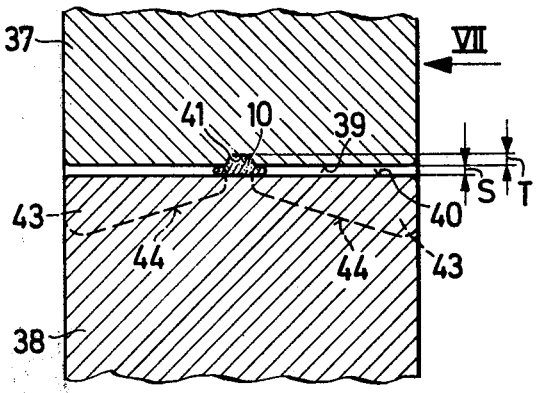
FIG. 8 illustrates a view taken on line VIII—VIII of FIG. 7.

Referring to FIGS. 7 and 8, the clamping surface 40 is flat but the clamping surface 39 is formed with a groove-like recess 41 disposed centrally in the direction of yarn length. The groove depth T is, as in the previous case, less than the thickness of the yarn 10 but the groove width corresponds substantially to the yarn thickness. Upon clamping of the yarn 10, some of the yarn cross-section is received in the recess 41 while the remainder is squeezed flat and retained in a gap S bounded by the flat portions of the clamping surface 39 and by the clamping surface 40. The jaw 37 has two pairs of guide teeth 42, 43 which are disposed consecutively as considered in the direction of yarn length and which project from the clamping surface 39. These sides 44 of each guide teeth pair 42, 43 which are near one another transversely of the yarn length are at an inclination to the clamping surface 39 and stop short thereof by the width of the recess 41 in the surface 39. The yarn 10 to be engaged therefore slides along the inclined sides 44 and moves in a constrained manner into the recess 41. The jaw 38 has inclined sides 45 so as to be introducible between the guide teeth pairs 42, 43.

The depth T of the recess in the clamps hereinbefore described is in all cases such that the clear gap S between the clamping surface is very small. This ensures that loose yarn paths, e.g. discrete filaments from a filamentus yarn, are reliably engaged and cannot leave the gap S.

Depending upon the kind of yarn material to be clamped, the recess can be formed to completely receive the piece of yarn to be engaged so that the clamping surfaces engage with one another without a gap being formed. Subject to the yarn being of appropriate resilience and strength, adequate clamping can be provided in such constructions as a result of the friction arising from deformation of the pieces of yarn. Thus, the groove depth should be, at most, equal to the yarn thickness occurring during clamping.

As FIG. 1 shows, the yarn clamp 12 of the projectile 11 is formed with a recess 21 but is devoid of lateral guide projections. The yarn clamps 12, and also e.g. yarn clamps of weft picking sticks or the like, can, of course, have appropriately disposed guide projections. One such projection can be disposed before and the other after the clamping region as considered in the direction of yarn length.

Both the clamping jaws of a yarn clamp can be formed with recesses, the combined depths of the two recesses being less than or equal to the thickness at clamping of the yarn to be engaged.

The yarn clamp according to the invention is of use in other textile machinery for processing, in particular, thick yarn-like material or, e.g. in knotting or packing machinery or the like.

What is claimed is:

1. A yarn clamp for a weaving machine comprising a pair of clamping jaws, each said jaw having a clamping surface opposite a clamping surface of the other jaw for registering with said opposite clamping surface to engage a yarn therebetween, at least one of said jaws being movable relative to the other of said jaws, and at least one of said jaws including a groove-like recess in said clamping surface thereof and a pair of flat portions of said clamping surface bounding said recess, said recess being disposed centrally of said one jaw and extending longitudinally of said jaws parallel to the yarn path and over a region in which said clamping surfaces register with each other to receive a yarn in said recess.

2. A yarn clamp as set forth in claim 1 wherein said recess has a depth at most equal to the yarn thickness occurring during clamping.

3. A yarn clamp as set forth in claim 1 wherein said recess has a segmental circular cross-sectional shape.

4. A yarn clamp as set forth in claim 1 wherein said recess has the shape of a groove receiving some of the cross-section of a yarn, said groove having a width transversely of the yarn corresponding approximately to the thickness of the unclamped yarn.

5. A yarn clamp as set forth in claim 1 further comprising at least two guide teeth on opposite sides of one of said jaws relative to the yarn, said guide teeth projecting towards the plane of the other of said jaws to define lateral boundaries of said region.

6. A yarn clamp comprising a pair of elongated arms disposed longitudinally of a yarn path, at least one of said arms being movable towards the other of said arms and said yarn path;

a pair of clamping jaws, each said jaw being disposed on a respective one of said arms and having a clamping surface opposite a clamping surface on the other of said jaws for registering with said opposite clamping surface to engage a yarn in said yarn path therebetween; and a groove-like recess in at least one of said clamping surfaces and flat portions said one clamping surface bounding said recess, said recess being disposed centrally of said one jaw and extending longitudinally of said yarn path and over a region in which said clamping surfaces register with each other to receive a yarn in said yarn path therein.

7. A yarn clamp as set forth in claim 6 further comprising at least two guide teeth on opposite sides of one of said jaws relative to the yarn path, said guide teeth projecting towards the plane of the other of said jaws to define lateral boundaries of said region.

8. A yarn clamp as set forth in claim 6 wherein said recess has a depth at most equal to the yarn thickness occuring during clamping.

* * * * *

UNITED STATES PATENT AND TRADEMARK OFFICE

CERTIFICATE OF CORRECTION

PATENT NO. : 4,117,871

DATED : October 3, 1978

INVENTOR(S) : FRANZ BURER

It is certified that error appears in the above-identified patent and that said Letters Patent are hereby corrected as shown below:

Column 6, line 4, after "portions" insert --of--

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*